United States Patent [19]

Corless

[11] Patent Number: 4,595,312

[45] Date of Patent: Jun. 17, 1986

[54] PNEUMATICALLY RESTORABLE RETRACTABLE PAVEMENT MARKER AND METHOD OF FABRICATING SAME

[76] Inventor: Murray B. Corless, P.O. Box 573, 156 Nicoline Avenue, Lucan, Ontario, Canada, N0M 2J0

[21] Appl. No.: 697,879

[22] Filed: Feb. 4, 1985

[30] Foreign Application Priority Data

Feb. 6, 1984 [CA] Canada ..... 446778

[51] Int. Cl.[4] ..... E01F 9/06

[52] U.S. Cl. ..... 404/11; 404/16; 116/63 R

[58] Field of Search ..... 404/6, 9, 10, 11, 16; 116/63 R; D10/113

[56] References Cited

U.S. PATENT DOCUMENTS

| | | | |
|---|---|---|---|
| D. 270,143 | 8/1983 | Flanagan | D10/113 |
| 2,073,968 | 3/1937 | Krebs . | |
| 2,185,488 | 1/1940 | White, Jr. . | |
| 3,257,552 | 6/1966 | Converso . | |
| 3,292,506 | 12/1966 | Kone . | |
| 3,717,076 | 2/1973 | Shields et al. . | |
| 3,980,410 | 9/1976 | Suhr et al. | 404/16 |
| 4,049,358 | 9/1977 | King et al. | 404/11 |
| 4,080,085 | 3/1978 | Dickson | 404/14 |
| 4,130,370 | 12/1978 | Kone | 404/11 |
| 4,140,418 | 2/1979 | Holley | 404/11 |
| 4,188,150 | 2/1980 | Sroka | 404/11 |
| 4,234,264 | 11/1980 | Baldi | 404/11 |
| 4,297,051 | 10/1981 | Robinson | 404/11 |
| 4,402,628 | 9/1983 | Grenier et al. | 404/16 |

FOREIGN PATENT DOCUMENTS

| | | | |
|---|---|---|---|
| 954101 | 9/1974 | Canada | 404/11 |

*Primary Examiner*—Stephen J. Novosad
*Assistant Examiner*—John F. Letchford
*Attorney, Agent, or Firm*—R. Craig Armstrong

[57] ABSTRACT

An improved traffic marker for deployment into the running surface of a roadway is disclosed wherein a light reflecting reflector thereof is normally positioned at above grade to enhance the visibility of retro-reflecting light impinging thereon from ongoing traffic. The reflector is mounted in a circumscribing holder, hardened to withstand the onslaught of vehicular traffic and of leading tungsten edges of snow plow blades. On impact, the holder descends into the marker, out of harm's way, carrying with it the reflector so that the reflector is not damaged. After impact, pneumatic pressure built up in the marker as a result of the descending action of the holder restores instantaneously the holder to above grade and hence the light reflecting surfaces as well. A four-step assembly operation of the unit develops a sub-assembly for holder and flexible membrane and a hermetic and pneumatically sealing boundary surface therebetween. The final assembly steps mount the sub-assembly into hermetically pneumatic sealing with the housing while disposing the reflector and its surrounding holder at above grade to the upper surface of the housing.

10 Claims, 14 Drawing Figures

PNEUMATICALLY RESTORABLE RETRACTABLE PAVEMENT MARKER AND METHOD OF FABRICATING SAME

BACKGROUND OF THE INVENTION

1. Field of the Invention

This invention relates to a road embedded light reflecting traffic marker, and particularly to an elevated light reflecting surface, that on impact, temporarily retracts into the marker housing and beyond harms way and immediately thereafter is restored to its elevated light reflecting position by pneumatic action.

Particularly with the advent of the automobile, various markers to delineate onward and return travelling portions of a highway have been conceived and implemented. Simplistically, one paints the road surface with white, yellow, or other colored lines.

In night conditions and more particularly in fog or with wet surfaces, such delineation is difficult to see unless illuminated either upon or within or the delineation is retro-light reflective; that is, reflects light essentially back to the source (sic. for an oncoming vehicle with head lamps on, light is reflected to the region from whence the light came; hence, visible light is reflected to the driver of the oncoming vehicle).

Thus, in order of overcome the foregoing in some applications, elevated markers, permanently or temporarily placed onto the travelling surface, or even adjacent thereto, delineate traffic flows.

The road embedded elevated reflectors have found great application in temperate climates where accumulations of light obscuring materials, such as snow, do not tend to accumulate over and to cover the retro-light reflective surface of such markers.

A typical retro-light reflective unit presently used in the moderate climates of North America (Georgia, Florida) is one manufactured by Amerace Corporation of Illinois, U.S.A. under the trade marks LIFE-LITE (trademark) by STIMSONITE (trademark). It is available in various colors. This light reflective reflector is hard mounted onto the rigid travelling surface portion of the road, whether that surface be asphalt or concrete. So long as sand, slush, and snow do not accumulate to a depth greater than that of the effective height of the reflective unit, about 2 cm., the reflective surfaces effectively reflect light at night. These particular units are generally secured to their surround directly, either mechanically or by an appropriate adhesive or bonding means; or, with the aid of an intermediate holder, which is affixed, appropriately, into the road surface, while the light reflective element is removably attached to the holder. In these temperate climates, where snow and slush and other road accumulations are not a problem, hard mounted traffic delineators as aforesaid have had stupendous commercial success.

Hard mounted reflector units, as aforesaid, are not totally satisfactory in less temperate climates when road clearing devices such as snow plows, or road graders, are used to scrape off any accumulations from the surface of the road. Such scraping generally pulls the hard mounted reflector unit, and/or the reflector, out of the road surface and in most cases also rips away subjacent and adjacent surface road material. Not only is the reflector itself destroyed or damaged so as to require replacement, but as a prerequisite, the road surface material ripped away must be restored. If an intermediate holder is used for the reflector, it generally is likewise damaged and requires replacement.

Thus, these devices are not cost effective where plowing is necessary to maintain the road clear as in winter where snow or slush accumulate.

Attempts over the years to make a commercially viable traffic marker whose light reflective surfaces are above grade (above the hard surface of the road), yet will not be damaged by plow, scraper and the like, and avoid costly road repair maintenace, or danger to snow plow operators, have generally been marginal at best.

For example, presently commercially available is a hard mounted traffic delineator with an elevated light reflective surface or lens. This lens is protected, on either side thereof, by shallow tapered planes extending both fore and aft; the planes acting as guides for the snow plow blade and the like so as to elevate the blade over the traffic marker while the blade travels over the marker as means to avoid the blade edge striking the light reflective surface and damaging the same. Superficially, such units, known as LIFE-LITE 96 (trademark) by the aforesaid Amerace Corporation appear to satisfy the demand for a plowable pavement marker. However, when the snow turns to slush, as a result of salting of the roads, salt builds up in the various crevices of such markers and obscures the light reflective lens whereupon during that duration the particulate remains accumulated on the light reflective lens, rendering it effectively non-light reflective at night. More importantly, however, during snow plowing, if perchance the surface of the road is slightly glazed with ice, typical conditions as exist through the upper midwestern United States of America and Canada, the snow plow operator will lose control because of this impact. There have been reports of snow plow operators actually being injured and equipment overturned and destroyed because of the basic failure of such units to be free of any resistance to snow plow blade impact. Such conditions cannot be tolerated particularly when it is appreciated that a snow plow out of control not only is unsafe to the snow plow driver, but to oncoming and following traffic. The aforesaid is a laudable although unsuccessful attempt to overcome the prior art in producing a plowable traffic delineator that disposes its light reflective surface at an elevation above the surface of the road, for it is well known in the art that light reflective surfaces above grade are superior to the painting of lines or to any other on surface demarcations whether they contain low or high degrees of light reflective properties. Any highway authority in North America recognizes that.

2. Description of the Prior Art

Of relevance, therefore, to this invention are three prior art retractable traffic delineators, all of which have failed to achieve any commerical success.

Krebs, U.S. Pat. No. 2,073,968 issued Mar. 16, 1937 entitled "Highway Marker", discloses a partially road embedded retractable traffic marker with an elevated light reflective element housed on a bottom or holder that is biased by the subjacent spring while held in its housing. It, however, has no protective ramps or guides to protect the light reflective element from scraping action as would occur by a snow plow blade and the upper portion of the housing is above grade and hence is incapable of responding to plowable conditions without damage.

Converso, U.S. Pat. No. 3,257,552 issued June 21, 1966, entitled "Flush Lamp Mounting Device", discloses a retractable traffic delineator whose light projecting element, in fact, is not retro-reflective, but rather the delineator itself contains a source of illumination surrounded by a protective plate which retracts simultaneously with the light source into the retractable traffic delineator. The internal housing of this device is open beneath so as to permit electrical conducting wires to exit the unit and to travel to a source of energy by which the light within the unit may be illuminated. Water seepage into the marker occurs through the aperture. Further, the resilient ring used is bonded to its adjacent body parts and under insite conditions, the bonding breaks down after frequent cyclical retractions and the unit is destroyed.

Kone, U.S. Pat. No. 3,292,506, entitled "Flush Lamp Mounting Device", discloses the flexible membrane with its upper surface in elevation subjacent to the upper surface of the marker housing. This provides an annular plenum for accumulation and adhere onto the light reflective surfaces. Further, the base aperture allows water to seep into the unit which in winter freezes, rigidifying the coil spring and inhibiting retractability when it is most needed.

SUMMARY OF THE INVENTION

As objects, the invention therefore contemplates a hermetically sealed and pneumatically restoring retractable traffic marker, that may be embedded, housing flush mounted, into the travelling surface of a road to normally dispose a retro-light reflective surface of a reflector super-adjacent the road grade. The reflector when impacted upon, descends into the marker housing and out of harms way, and after impact is powered by the increasing air pressure within the marker housing to be restored into its normal elevated raod position instantaneously. In fact, during the restoration cycle some oscillation about its normal pre-impact elevation occurs. This recovery oscillation, which is heavily dampened to 2 or 3 cycles, has a tendency to scatter off any loosely accumulated debris such as sand, slush and the like from the light reflecting surface, cleansing it. The light reflective surface nestles in and is affixed to a protective surround in the form of a reflector holder while composed of material rigid enough to withstand degradation from consistent impacts by vehicular tires and the tungsten leading edges of snow plow blades. The upper surfaces of the marker are smooth and continuous so as to inhibit the accumulation of any debris.

The invention therefore contemplates a retractable traffic marker whose body, with upper surface, is adapted for fixed deployment into a rigid running surface or grade of a roadway so as to dispose the upper surface flush with the running surface, while further disposing, above grade, a light reflector for reflecting light back toward oncoming vehicular traffic, the improvement comprising;

(a) a reflector holder with curved upper sheet surface defining a slotted recess whose prolongation with said sheet defines an open area;

(b) means for affixing said reflector into said area so as to expose to display a light reflecting surface from the reflector;

(c) the upper sheet of the holder profiled to surmount the profile of the reflector and hence to shield the reflector from direct impact from oncoming vehicular traffic;

(d) a marker housing essentially formed as one closed end cylinder and with other end open;

(e) sealing flexing means extending across said open end to hermetically seal the open end with a predetermined volume of air; and, (f) means for sealingly affixing the holder to said flexing means whereby on impact to the holder, the holder descends into the housing and after impact is restored to its former above grade position by transitory pneumatic forces generated within the housing during retraction.

BRIEF DESCRIPTION OF THE DRAWINGS

The invention will now be described by way of example, with reference to the accompanying drawings, in which.

DETAILED DESCRIPTION OF THE PREFERRED EMBODIMENT

Figure 1:
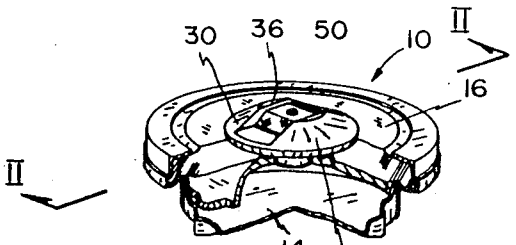
FIG. 1 is a perspective, partially in section, showing the structure of the pneumatically restoring retractable traffic marker according to my invention.

Referring to FIG. 1, a hermetically sealed traffic marker with an impact retracting, pneumatically restoring, light reflector according to the invention is generally shown as 10 and comprises only six parts: a lower, closed bottomed, generally cylindrical housing 14; an upper annular resilient sealing ring 16, a retaining flanged annulus 18 which urges upon the perimeter of the ring 16, and sealingly secures the same to the housing 14, as by a plurality of circumferentially disposed spot welds 19; a shielding reflector holder 30; an internal passive anchor plate 40, into which the holder 30 is fixedly secured so as to urge the center portion of the resilient annular ring 16 into sealing compression therewith; and, a light reflector 50 carrying fore and aft retro-light-reflective surfaces 52 and 54 protectively nesting in a slot 34 defined by the holder 30. Conveniently the housing anchor plate and flanged annulus are stamped from galvanized sheet steel while the holder is cast or machined steel to shape with a hardness between 100 and 350 Brinell; cast steel with a high nickel content is satisfactory.

The resilient sealing ring 16 is an annulus with a central aperture 26, molded of vulcanized rubber and resistant to road salts, corrosion and from breakdown by ozone and ultraviolet light. Similarly, the anchor plate 40 is annular like with a central aperture 42. The shielding reflector holder 30 has a depending stud or shaft 32 sized to nest through apertures 26 and 42—see FIG. 4A. As will be apparent hereafter, these components are compressed and the distal end of the stud 32 welded by an annular weld 43 to the undersurface of the plate 40—FIG. 4B—so as to become one flexingly responsive subassembly as will become apparent.

The reflector holder 30 has a slot profile to accommodate the reflector 50. The reflector 50 possesses forward reflective surface 52 and rearward reflective surface 54 each inclined to the horizontal (see FIG. 3) at approximately 30 degrees (about 150 degrees from the center line CL in FIG. 3) while having a flat non-reflecting top 56. In the floor of the recess 34 is a threaded aperture, not clearly shown in any of the figures, and the reflector 50 has an aperture 55 extending through it. Through this aperture 55 extends a threaded screw 60 to threadingly mate into the floor. Thus the reflector 50 is removably secured to the holder 30 so that it may be replaced if damaged, or if various other colors for reflective surfaces 52 and 54 are to be used from those originally selected.

Figure 3:
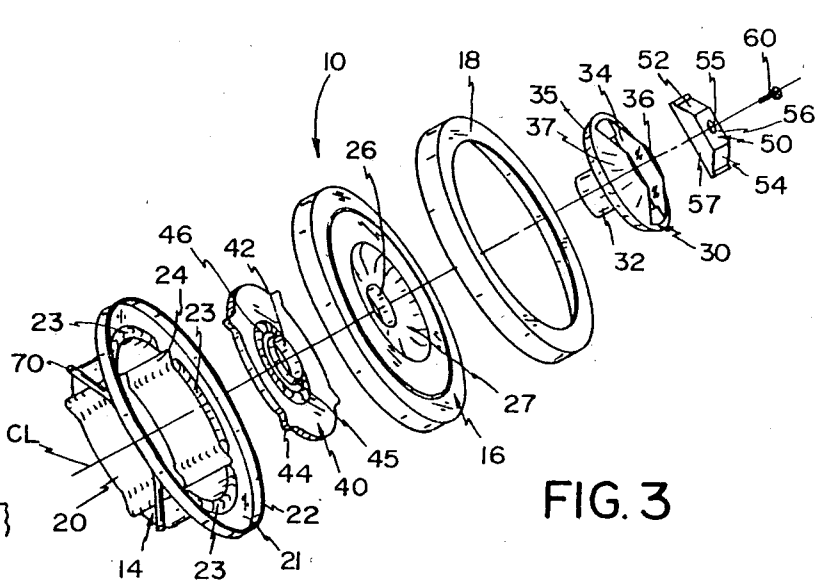
FIG. 3 is an assembly view of the embodiment of FIG. 1.
Figure 2:
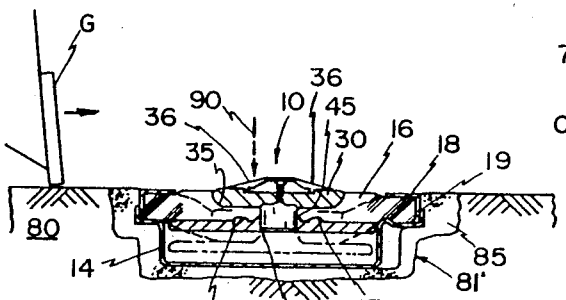
FIG. 2 is a section along lines II—II of FIG. 1.

Careful review of FIGS. 1 through 3 will indicate that, in fact, the housing 14 is not actually perfectly cylindrical, but has 4 vertically oriented curved like channels 24. The annular anchor plate 40 has, as well, four outwardly projecting fingers 44 sized to mate in the vertical slots 24. Since the rubber ring 16 is resilient and, as we have disclosed hereafter, the mating relationships between the anchor plate 40, resilient ring 16 and holder 30, on the one hand, and the housing 14, ring 16 and flange annulus 18, on the other, provide a hermetically sealed, air entrapped unit wherein air is entrapped within the housing body in which the anchor plate resides; thus, when impacted on top, the holder 30 with reflector 50 descends downward in the direction of arrow 90 of FIG. 2 into the phantom position shown at which location the elevation of the upper flat surface 56 of the reflector 50 is below grade of the road 80. Air pressure is built up within the housing when the anchor plate resides in the phantom position depicted in FIG. 2 since that space is reduced to minimum at impact; while the pneumatic pressure contained in that space rebounds, together with the aid of the resiliency of the ring 16, the reflector 50 into its elevated position again on impact termination.

In order, therefore, to maintain hermetic and pneumatic sealing of the inner space within the housing, a perfect inner radial seal between rubber ring 16, holder 30 and anchor plate 40 is required as well as between the outer radial juxtaposed surfaces of the resilient ring 16, housing 14, and flanged annulus 18.

Referring therefore to FIGS. 2, 3, 4A and 4B, the anchor plate 40 is swaged at 45 to form an upper annular swaged edge surrounding the central aperture 42. The under-surface of the resilient ring 16 is also accommodatingly swaged so as to mate tight with the anchor plate as will become more clear. The upper surface of the anchor plate 40 defines an uprising annular bead 42, of diameter greater than that of the annular swaged edges but less than that of the holder, profiled to mate in an accommodating annular slot 17 defined in the underside of the resilient rubber annulus 16.

The holder body, from its shaft 32, extends arcuately and radially upward as a smooth curving sheet into a straight disc-like under-surface that transforms at its distal radial edge 35 into a snub (an upward curving and then reversingly curving sheet) to be transformed into an uprising three-dimensional conical upper surface 36 truncated at its upper extremity 37. It is in this three-dimensional conical surface 36 that the reflector accommodating slot 34 is defined by the holder body. Careful review, particularly of FIGS. 1 and 2 will indicate that the upper profile of the reflector 50 is always juxtaposed subjacent to the surrounding conical surface 36. In this way the conical surface 36 provides a shielding protection to the delicate reflector, shielding it from direct impact of oncoming vehicular traffic, most dangerously the leading tungsten edge of a snow plow blade G.

Referring to the cylindrical housing 14, its upper open end is transformed through an uprising circumferential bead into an annular outwardly projecting flanged surface 21 and then into a radial upstanding wall 22 of larger diameter formed at the outer radial extent of the flange 21. The uprising circumferential bead 23 is partitioned into 4 sectors, each sector separated by one of the vertical channels 24 that guides a finger 44.

Figure 4C:
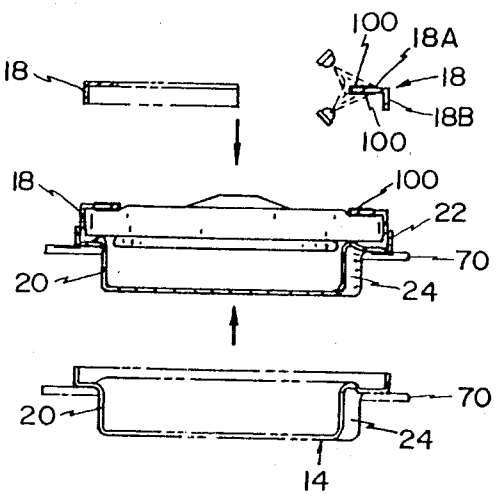
FIGS. 4A through E, illustrates the fabrication technique according to the invention.
Figure 4B:
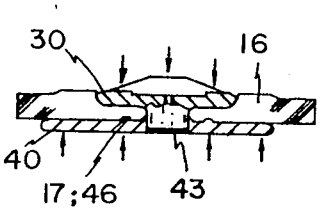
Figure 4A:
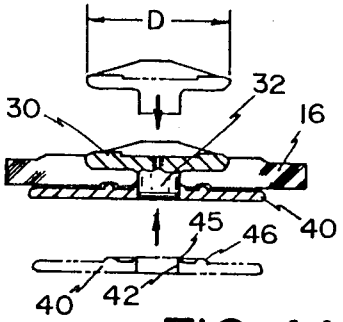
Figure 4E:
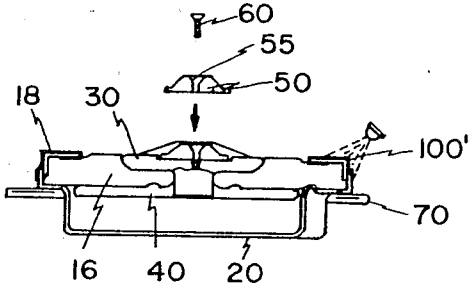

In order to fabricate such a device, a number of fabricating steps are necessary; the first is shown in FIG. 4A and is the pre-assembly of the holder, anchor plate, and resilient rubber ring 16 so that the shaft 32 thereof projects through the central aperture 26 into the corresponding mating aperture 42 in the anchor plate 40. Referring to FIG. 4B, these 3 components are then subjected to a pressure, depicted by the arrows thereof, of approximately 1000 pounds, while the distal end of the shaft 32 is braised or welded at 43 to the under-surface of the anchor plate 40. It is important that the pressure be applied consistently during welding so that after welding the 3 components are essentially a unitary subassembly. It will be appreciated that these 2 steps generate a water tight seal across the boundary between holder, ring and anchor plate. More specifically, since the diameter D of the holder is larger than the diameter d of the bead 46 and mating slot 17, that region of the resilient ring 16 bounded by the prolongation of the diameter d through the ring to holder and the diameter of the stud 32 is maintained under compression and is fixed and never moving relative to adjacent parts irrespective of the relative temporal location of the outer radial edge of the ring 16—see the phantom positions of FIG. 2.

Figure 4D:
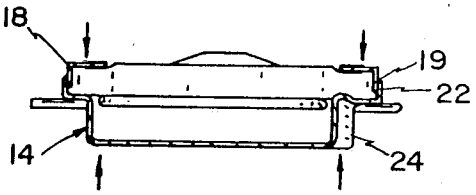

The subassembly of FIG. 4B is then mated with the housing and sealingly retained thereon by the retaining flanged annulus 18 in the following manner. Firstly, the annulus 18 has its inner radially disposed surface 18A coated with a preservative such as coal tar paint and the like 100 so that the coating 100 is evenly disposed on the upper and the lower surfaces as well as the inner circumferential edge thereof. Next the subassembly is inserted onto the cylindrical housing and the retaining flanged annulus 18 nested thereover. Thereafter, the annulus 18 and housing are subjected to pressure, arrows of FIG. 4D, so as to compress the resilient outer circumference of the annulus 16 there between while simultaneously, a welding operation occurs to place welds at the over nesting seam juxtaposed and formed by the depending arm 18B of the retaining flange annulus as well as over its axially depending exposed arm 18B and also over the weld 19 including part of the uppermost extremity of the upstanding radial wall 22. Assembly of the retractable traffic marker is completed by placing the reflector 50 into the slot 34 and securing the same with the aid of threaded screw 60 extending through the aperture 55 into a threaded mating hole of the holder.

Referring to FIG. 2, the surface of the pavement 80 is broken away by drilling, chipping or other convenient means to form a pocket. The pocket is filled, in part, with an aggregate 85 or alternatively with a suitable epoxy; in some applications, rubberized ashpalt will suffice. The upper surface 18A of the surrounding retaining annulus is placed at an elevation coincident with or fractionally below, a millimeter or so, of the actual surface of the pavement 80 by pushing the retractable marker 10 into the partially filled pocket. The excess epoxy or aggregate 85 is removed while the remaining material is allowed to set whereupon the housing body becomes firmly imbedded flush or preferably at a slightly lower fixed elevation relative to the surface of the pavement 80. The upper surface of the holder 30 is clearly above grade and the reflector 50 positioned, when not impacted, at above grade exposure. In response to impact, as earlier described, as by snow plow blade G, the holder 30 with reflector 50 descends into the housing (arrow 90), and after impact the pneumatic pressure built up during descent within the housing (particularly if a coal tar epoxy such as EPOXAL (trademark) from Niagara Protective Coatings of Niagara Falls, Canada is used because the abrasive resistence of the coal tar coating is greater than that of the road asphalt itself, or of concrete when concrete is used as a road running surface), returns the reflector to above grade position.

Figure 7:
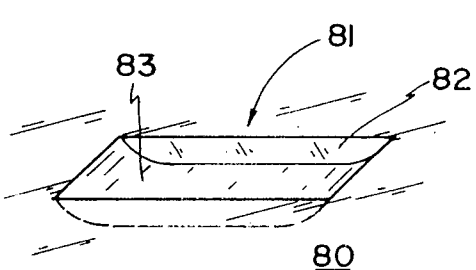
FIG. 7 is a drawing of a rectangular pocket cut into the surface of the road for accommodating the housing of FIG. 6.
Figure 8:
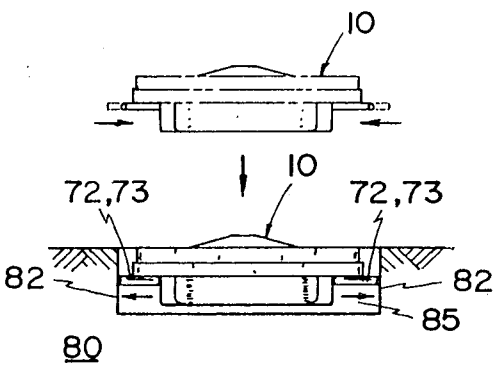
FIG. 8 is a section similar to that of FIG. 5 showing the installation of the marker of FIG. 6.
Figure 6:
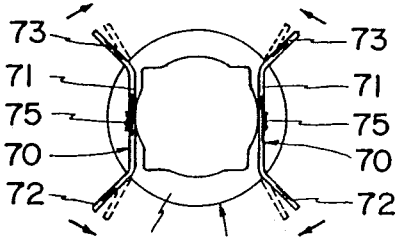
FIG. 6 is a plan view of an alternative embodiment of the housing showing resilient centering arms.

Alternatively, and referring to FIGS. 6, 7 and 8, there may be laterally welded, to the outside of the housing 14, below the flange, a pair of resilient lateral arms 70 having a straight central section 71 and forward and rearward extending fingers 73 and 72. The center of each arm is welded at 75 to the exterior of the housing and the fingers are resilient so as to index in a rectangular accommodating pocket 81 cut into the road surface 80. The pocket has a floor 83 and opposite parallel margins 82. It is against these parallel margins 82 that the distal ends of the fingers 72 and 73, rest as shown in FIG. 8, as the fingers move into the phantom position shown in FIG. 6. Thus the marker may be mounted into the pocket and set flush with the upper surface of the road prior to insertion of the surrounding aggregate (not shown in FIG. 8) but shown in FIG. 2. Thus, either embodiment may be used as a marker but the embodiment of FIGS. 6, 7 and 8 is preferred when used with a parallel side accommodating pocket, and simplifies installation.

The coating 100 that is applied to the annulus 18 and to the fixed exterior of the upper circumferencial wall 22 may be color co-ordinated with the color of the reflective surfaces 52 and 54. When a plurality of such color co-ordinated road markers are placed in pavement, the need to actually paint colored lines on the road may be eliminated. This has a major advantage in reducing the cost of highway maintenance.

Figure 5:
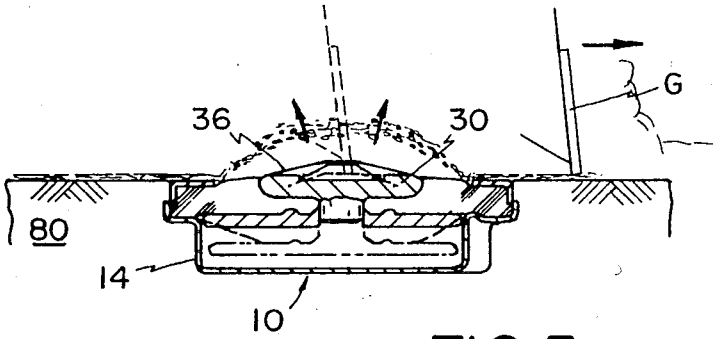
FIG. 5 is a section through the marker when installed and after impact by a snow plow.

Referring to FIG. 5, in operation, after for instance a snow plow has traversed across the marker, the holder 30 moves up from the phantom position of FIG. 5 to the solid position of FIG. 5 and in fact exceeds or uprises past its solid position shown in FIG. 5 and is dampened quickly through 2 or 3 oscillations. These oscillations tend to scatter off, the arrows in FIG. 5, the accumulated debris which may have been resting on the upper surfaces of the marker. This oscillation action causes self-cleaning of the marker and of the reflective surfaces 52 and 54.

[The above disclosure is as originally presented in Canadian patent application Ser. No. 446,778 filed Feb. 6, 1984. A claim to Convention priority is therefore made in connection with the above disclosure, based on the Canadian filing date. The following supplementary disclosure is being presented for the first time in this application, and thus is not subject to any claim to Convention priority.]

Figure 10:
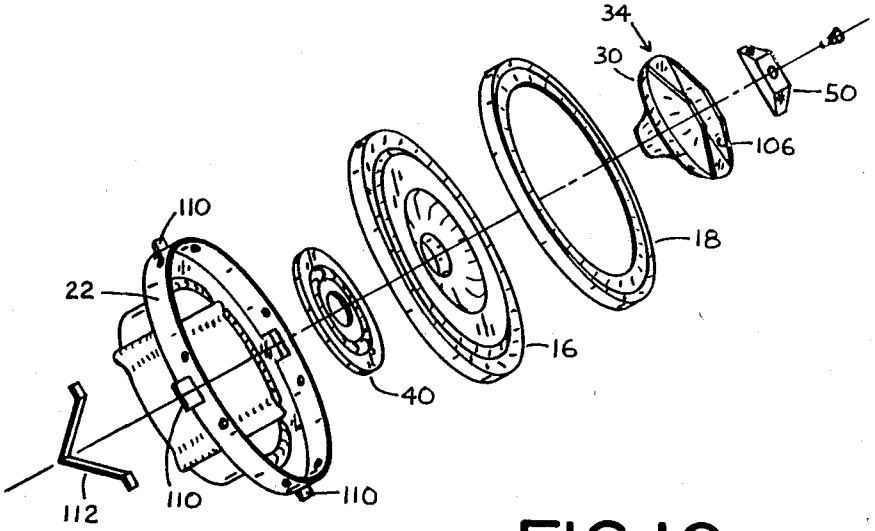
FIG. 10 is an exploded view, showing the assembly of the improved embodiment of the traffic marker.
Figure 9:
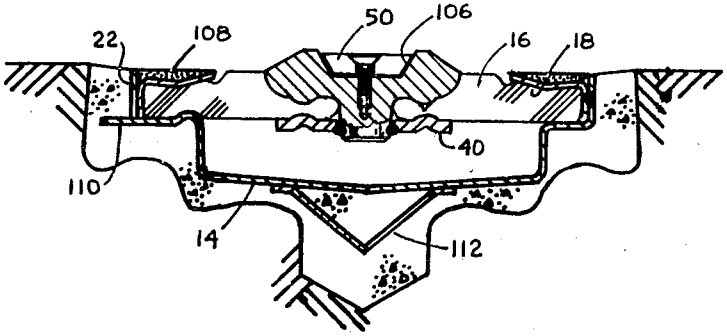
FIG. 9 is a cross-sectional drawing of an improved embodiment of the traffic marker, shown installed in a road surface.

Referring now to FIGS. 9 and 10, an improved embodiment of the invention is illustrated. In this embodiment, the profile of the flange annulus 18 is changed. The upper surface thereof, instead of being essentially planar and intended for installation substantially flush with the road surface, is concave. The inner periphery of the flange annulus is substantially at the level of the road surface, or slightly below, while the outer periphery is a small distance below the level of the road surface. The radial upstanding wall 22 is higher than in the basic embodiment, extending essentially up to the level of the road surface. The flanged annulus 18 and the upstanding wall 22 are welded together as in the basic embodiment. In the concave depression defined by the upper surface of the flanged annulus 18, an abrasion-resistant mixture 108 of sand and epoxy is deposited. The ratio of sand to epoxy is in the range of approximately 1:1 to 3:1. A ratio of 2:1 has been found to be most appropriate. This abrasion-resistant composition permits the marker to accept wear and impact more favourably, without having the wear affect the structural integrity of the marker itself.

The slot 34 in the reflector holder 30 has interior sides 106 which angle upwardly and outwardly away from the vertical at an angle of approximately 35 to 40 degrees. This angling reduces any tendency which there might otherwise be for sand, road dirt, and snow to accumulate against the reflective faces of the reflector 50.

The resilient lateral arms 70 are replaced by several projecting tabs 110 which are stamped out and folded down from the upstanding wall 22.

The anchor plate 40 is reduced in outside diameter, so that the rubber annulus 16 is provided with greater freedom of movement in response to an impact. The projecting fingers 44 and the vertical channels 24 have been eliminated.

The shape of the bottom of the housing 14 has been changed, so that it is no longer flat, but slightly conical, the centre of the housing bottom being slightly lower than its periphery. This improves the flow of the sealing compound during the installation of the marker, and thereby makes for a simpler, faster and more secure installation of the marker.

The bottom of the housing has also been provided with an anchoring arm 112, projecting downwardly from the bottom of the housing, in order to provide better anchoring of the marker. The pocket filling 85 flows in between the anchoring arm and the bottom of the housing and thereby improves the anchoring.

The pocket filling is mixture of DURACRETE (trademark) mixed with an acrylic for greater shock handling capability and for rapid curing time for easier installation.

What is claimed as the invention is:

1. Traffic marker, which comprises a reflector, an elastomeric diaphragm having an outer rim, and a housing, where the diaphragm is clamped between the housing and an annular ring, and sealed to the housing in such manner as to entrap a volume of air between the housing and the diaphragm, and where the reflector is sealed to the diaphragm;

where the ring and the housing are provided with respective complementary interengaging guide surfaces, which are so disposed that the ring and housing may slide relatively upon the guide surfaces in the direction normal to the diaphragm;

where the ring and the housing are provided with respective complementarily opposed flanges, the flanges being so disposed as to clamp between the flanges with a clamping force the outer rim of the diaphragm when the ring and housing are caused to slide together;

and where the ring is welded to the housing at a pre-determined value of the clamping force on the rim.

2. Marker of claim 1 where the reflector is mounted in a holder, and where the inner rim of the diaphragm is clamped between the holder and a retainer;

and where the holder and the retainer are welded together at a pre-determined value of the clamping force on the inner rim.

3. Marker of claim 1, where the guide surfaces are respective right cylinders, one inside the other.

4. Marker of claim 3, where the ring and the housing are welded together at the guide surfaces.

5. A traffic marker for installation in a road surface, comprising:

a housing, having a closed bottom, upstanding walls, and an open top, said upstanding walls having a flange portion;

a centrally apertured flanged annulus mating with said housing across said open top, and attached to said housing;

a centrally apertured disc-like resilient flexing member sealingly compressed with a clamping force at a peripheral annulus between said flanged annulus and said flange portion of said housing;

a reflector holder installed across said central aperture of said flexing member and having a downward projection protruding through said central aperature;

a retaining plate attached to said downward projection of said reflector holder to as to sealingly compress said flexing member between said retaining plate and said reflector holder; and at least one reflector element held in said reflector holder for facing oncoming traffic for retroreflection of light projected towards the traffic marker by said traffic;

and in which said reflector holder holds said reflector in a slot defined in an upper surface of the reflector holder, and in which the interior sides of said slot angle upwardly and outwardly away from the vertical;

and where the centrally apertured flanged annulus is welded to the housing at a pre-determined value of the clamping force on the peripheral annulus of said centrally apertured disc-like resilient flexing member.

6. A traffic marker as recited in claim 5, in which the interior sides of said slot angle upwardly and outwardly away from the vertical at an angle of approximately 35 to 40 degrees.

7. A traffic marker for installation in a road surface, comprising:

a housing, having a closed bottom, upstanding walls, and an open top, said upstanding walls having a flange portion;

a centrally apertured flanged annulus mating with said housing across said open top, and attached to said housing;

a centrally apertured disc-like resilient flexing member sealingly compressed at a peripheral annulus between said flanged annulus and said flange portion of said housing;

a reflector holder installed across said central aperture of said flexing member and having a downward projection protruding through said central aperature;

a retaining plate attached to said downward projection of said reflector holder to as to sealingly compress said flexing member between said retaining plate and said reflector holder; and at least one reflector element held in said reflector holder for facing oncoming traffic for retroreflection of light projected towards the traffic marker by said traffic;

and in which the upper surface of said flanged annulus has a concave depression, and in which said depression is filled with a mixture of sand and epoxy in a ratio of sand to epoxy in the range of approximately 1:1 to 3:1, for abrasion resistance.

8. A traffic marker as recited in claim 7, in which the ratio of sand to epoxy is approximately 2:1.

9. Method of making a traffic marker, comprising the steps:

of providing a reflector, a diaphragm of elastomeric material having an outer rim, a housing, and an annular ring;

of placing the outer rim of the diaphragm between the housing and the ring;

of compressing the housing and ring together in a press, in such a manner as to clamp the rim therebetween;

of adjusting the press pressure to a pre-set value;

and of welding the ring to the housing while the said press pressure is maintained.

10. Method of claim 9, which includes attaching the reflector to the diaphragm by the steps:

of mounting the reflector in a holder;

of providing a retainer;

of placing the inner rim of the diaphragm between the holder and the retainer;

of compressing the holder and retainer together in a press, in such a manner as to clamp the inner rim therebetween;

of adjusting the press pressure to a pre-set value;

and of welding the retainer to the holder while the said pressure is maintained.

* * * * *